US012800165B2

(12) United States Patent
Travis et al.

(10) Patent No.: US 12,800,165 B2
(45) Date of Patent: Nov. 17, 2026

(54) WINDOW-BASED HVAC INTERFACE SYSTEM

(71) Applicant: Metro Loft Developers, LLC, New York, NY (US)

(72) Inventors: Robert Travis, New York, NY (US); Chaim Weiss, New York, NY (US)

(73) Assignee: Metro Loft Developers, LLC, New York, NY (US)

( * ) Notice: Subject to any disclaimer, the term of this patent is extended or adjusted under 35 U.S.C. 154(b) by 390 days.

(21) Appl. No.: 18/605,336

(22) Filed: Mar. 14, 2024

(65) Prior Publication Data

US 2025/0290650 A1 Sep. 18, 2025

(51) Int. Cl.

| | |
|---|---|
| ***F24F 7/013*** | (2006.01) |
| ***F24F 1/031*** | (2019.01) |
| ***F24F 13/22*** | (2006.01) |
| *F24F 7/00* | (2021.01) |

(52) U.S. Cl.

CPC ..... *F24F 7/013* (2013.01); *F24F 1/031* (2019.02); *F24F 13/224* (2013.01); *F24F 2007/001* (2013.01)

(58) Field of Classification Search

CPC ..... F24F 7/013; F24F 1/031; F24F 13/224; F24F 2007/001

See application file for complete search history.

(56) References Cited

U.S. PATENT DOCUMENTS

2020/0018497 A1* 1/2020 Aquino ..... F24F 11/0001

* cited by examiner

*Primary Examiner* — Steven S Anderson, II

(74) *Attorney, Agent, or Firm* — Wiggin and Dana LLP

(57) ABSTRACT

A window-based HVAC interface system is provided as a convenient solution for installing and interfacing to a ventilation system in a new building or for upgrading an aging HVAC system in an existing building. The HVAC interface system may be optionally integrated with a window. The HVAC interface system includes separate but connectable components, including a hooded vent unit extending from the interior of a room, through a wall or window structure to the exterior, and connected thereto, a plenum box disposed in the room interior. The plenum box is configured to facilitate connection to an HVAC system such as an HPAC unit. The hooded vent unit may be provided as a portion of an integrated window assembly.

5 Claims, 11 Drawing Sheets

WINDOW-BASED HVAC INTERFACE SYSTEM

FIELD OF THE INVENTION

This present invention generally relates to systems and methods for implementing heating, ventilation, and air conditioning (HVAC) in residential and commercial buildings, and more specifically relates to an interface system for interfacing HVAC equipment with an air intake and exhaust hood which may be used with and optionally integrated with a window.

BACKGROUND OF THE INVENTION

Proper ventilation is crucial for maintaining a comfortable and healthy indoor environment in buildings. HVAC systems are used to provide the necessary ventilation in situations where windows alone cannot provide sufficient fresh air ventilation. HVAC systems serve multiple purposes, including circulating heated and cooled air, regulating air quality, and providing proper ventilation by removing stale air through an exhaust vent and introducing clean, fresh air via an intake vent into an indoor environment. Proper ventilation is necessary to maintain a balanced indoor environment, to maintain a comfortable humidity level and remove airborne pollutants. Conventional HVAC systems, however, require air ducts and grills that restrict the size of external windows and disrupt the aesthetics of a room's interior design. Moreover, in a building equipped with aging HVAC equipment, indoor air quality and energy efficiency may be degraded and the equipment itself may be difficult to service or upgrade. It may also be desirable to upgrade or retrofit HVAC systems in older buildings that may not have contemplated modern ventilation needs when originally designed and constructed. However, upgrading of preexisting HVAC equipment is costly and often limited by the existing dimensions of window openings and venting connections at the installation site.

Other disadvantages of conventional HVAC systems include unsightly bulky internal and external appearances, lack of air tightness resulting in discomforting air drafts, loss of energy and a correspondingly high cost to operate.

Thus it is desirable to provide a window-based HVAC system that can be used in new construction or that can be retrofit to an existing building, without reducing window sightlines, and that can be installed easily from the building's interior and connected to venting infrastructure or HVAC equipment without the need for costly and time-consuming modifications to the building or the venting infrastructure. By providing an efficient way to install intake and exhaust vents in existing walls or window openings, building owners and occupants can enjoy improved indoor air quality, temperature and humidity regulation, and energy efficiency.

BRIEF SUMMARY OF THE INVENTION

In order to overcome and mitigate the deficiencies noted above with conventional HVAC systems, this disclosure presents a convenient solution for installing a ventilation system in a new building or for upgrading an aging HVAC system in an existing building. The solution includes separate but connectable components, including a hooded vent unit and a plenum box.

In an embodiment, the hooded vent described herein provides an efficient and effective solution for residential and commercial buildings, detached houses and similar structures. The vent includes a housing that extends through a window structure or room wall to the outside and features a hood at the portion extending outside the window structure. This hood shape efficiently and effectively prevents infiltration of rain, other precipitation or particles, birds, and insects via the vent opening. Moreover, in contrast to a louver-type vent which occupies a relatively large amount of surface area, the external portion of the hooded vent according to an embodiment of the present invention extends generally horizontal with respect to the window surface, thus occupying less surface area of the window structure. The hooded vent is generally orthogonal to the window structure, such that the air inlet portion of the vent extends generally horizontally and is nearly entirely exposed to the open air thereby allowing for a smaller air opening and a larger window. The vent housing may be made of any durable and weather-resistant materials suitable for withstanding external elements.

The interior of the hooded vent is partitioned into separate channels for intake and exhaust air flow. This partitioning enables the dual functionality of the vent, to intake outside air, which is then used in connection with heat transfer for an air conditioning unit, for example, and then exhausting the air to the outside after it has run through the air conditioning unit. The separate channels integrated into a single vent assembly facilitate installation in a building wall as only a single opening in the wall is required. In other words, because the intake and exhaust channels are integrated into a single vent, installation is simplified as there is no need to create separate openings for intake and exhaust in the building wall. As is described in further detail below, the internal partition of the hooded vent may be configured to allocate the respective volume of each channel inside the hooded vent.

The hooded vent is also advantageously designed for installation when replacing or upgrading windows in an existing building. Because the vent is installed as part of the window structure or adjacent to the window opening, convenience and efficiency of the upgrading process are maximized. This feature eliminates the need for additional modifications to the building structure, and thus reduces both installation time and costs. The vent can be securely mounted and sealed to ensure a tight fit, thereby minimizing air leakage and maximizing energy efficiency.

In HVAC systems, plenum boxes play a crucial role in facilitating the intake and exhaust of air. The plenum box described herein is an innovative component of an HVAC system and operates as an intermediate junction between the externally extending vent and the intake and exhaust lines of the HVAC system to which it is connected. The plenum box may be fabricated from any durable and lightweight insulated materials suitable for HVAC applications. So as not to occupy excessive space, the plenum box is designed to fit to the window frame, seal to it, and fit within the interior of a building.

Like the hooded vent, the plenum box is also partitioned internally into at least two channels, an intake and an exhaust channel, separated by a partition. Different configurations of the partition are contemplated to allocate the respective intake and exhaust channels of the internal volume of the plenum box in different ratios so as to accommodate the air flow requirements of various applications. For example, configuring the partition to allocate a larger volume to the exhaust channel enhances the overall system capacity and efficiency to expel air. The particular configurations of the vent and plenum partitions may be fixed at the time of assembly or may be adjustable. In either case, the ability to adjust and control the relative volumes of the intake and exhaust airflows allows the system to be custom tailored to accommodate specific HVAC requirements and achieve enhanced airflow regulation and improved energy efficiency.

In some embodiments, the plenum box may contain an integrated drainage system configured to drain away condensate. In such an embodiment, a plenum drain provided at the bottom of the plenum box is tied to a condensate drain that is easily connectable to the drainage system of a heat pump air-conditioning (HPAC) system, for example.

The plenum box is designed to attach directly to the externally extending (through wall) vent, forming an airtight and waterproof seal with the vent and the abutting window frame. The plenum box is also designed to be mounted substantially flush with the wall. The plenum box may be secured to the window frame and wall by any suitable means, including but not limited to bolts, clips, brackets, and hooks. The low-profile design and flush mounting of the plenum box fits within the so-called green wall zone and provides a clean and unobtrusive appearance that contributes to an aesthetically pleasing indoor environment.

One significant advantage of the window-based HVAC system disclosed herein is that it is designed to be easy to install at the time of upgrading windows in a pre-existing building. Older windows in pre-existing buildings may require replacement or an upgrade for various reasons. For example, the windows may lack adequate thermal or sound insulation. Upgrading to energy-efficient insulated windows can help reduce energy usage and operating costs in a building while improving the comfort of the building's occupants. Inadequate sound insulation or soundproofing may allow external noise to permeate living and work spaces, and cause discomfort to the occupants. Soundproofing may be especially important in industrial settings, in noisy urban environments, or for buildings located near sources of noise such as highways, railroad lines, and airports. Additional reasons for window replacement including improving the safety and security of the building by installing modern windows that feature reinforced glass, sturdy frames, and secure locking mechanisms.

In any event, whatever the reason for window replacement, the externally extending hooded vent of this disclosure is well suited for installation at the same time as the window replacement work. Because intake and exhaust channels are both contained within a single vent assembly, the vent therefore requires only a single opening to be made in a window structure or an exterior wall. The hooded vent, typically located immediately adjacent to a window as part of the window structure, is designed to be installed without requiring any modification of the metal spandrel above or below the window.

A further advantage of an embodiment of the present invention is that all installation work can be performed from the interior of the building without the need for scaffolding or rigging. As noted above, windows are often replaced in order to make a building more energy-efficient and it often is advantageous to replace or upgrade an existing HVAC system at the same time. The ability to upgrade building windows and the HVAC system at the same time may be particularly advantageous to building owners who desire to lessen the disruption to building services during the installation work. Other building systems would be unaffected during the installation. The hooded vent and plenum box are designed to minimize field work and to be installed essentially as "plug and play" components that can be installed in an apartment while tenants occupy apartments immediately above and/or below the work site.

BRIEF DESCRIPTION OF THE DRAWINGS

The features and advantages of this disclosure will be more fully understood with reference to the following, more detailed description, when taken in conjunction with the accompanying figures, wherein.

DETAILED DESCRIPTION

As described herein, the disclosed system provides an appropriate intake/exhaust vent, a plenum box, condensate drainage lines, and other associated connecting hardware suitable for installation in a new building or as a retrofit upgrade to existing ventilation infrastructure, such as a heat pump air-conditioning (HPAC) unit, so as to provide heating, cooling, and fresh air ventilation to the building without the need for visible air ducts, and extensive redesign or renovation work. The system intended to be integrated into or retrofit to the building's structure and existing ventilation infrastructure, and can be concealed in a wall, adjacent to a window frame, or in a ceiling.

Figure 1:
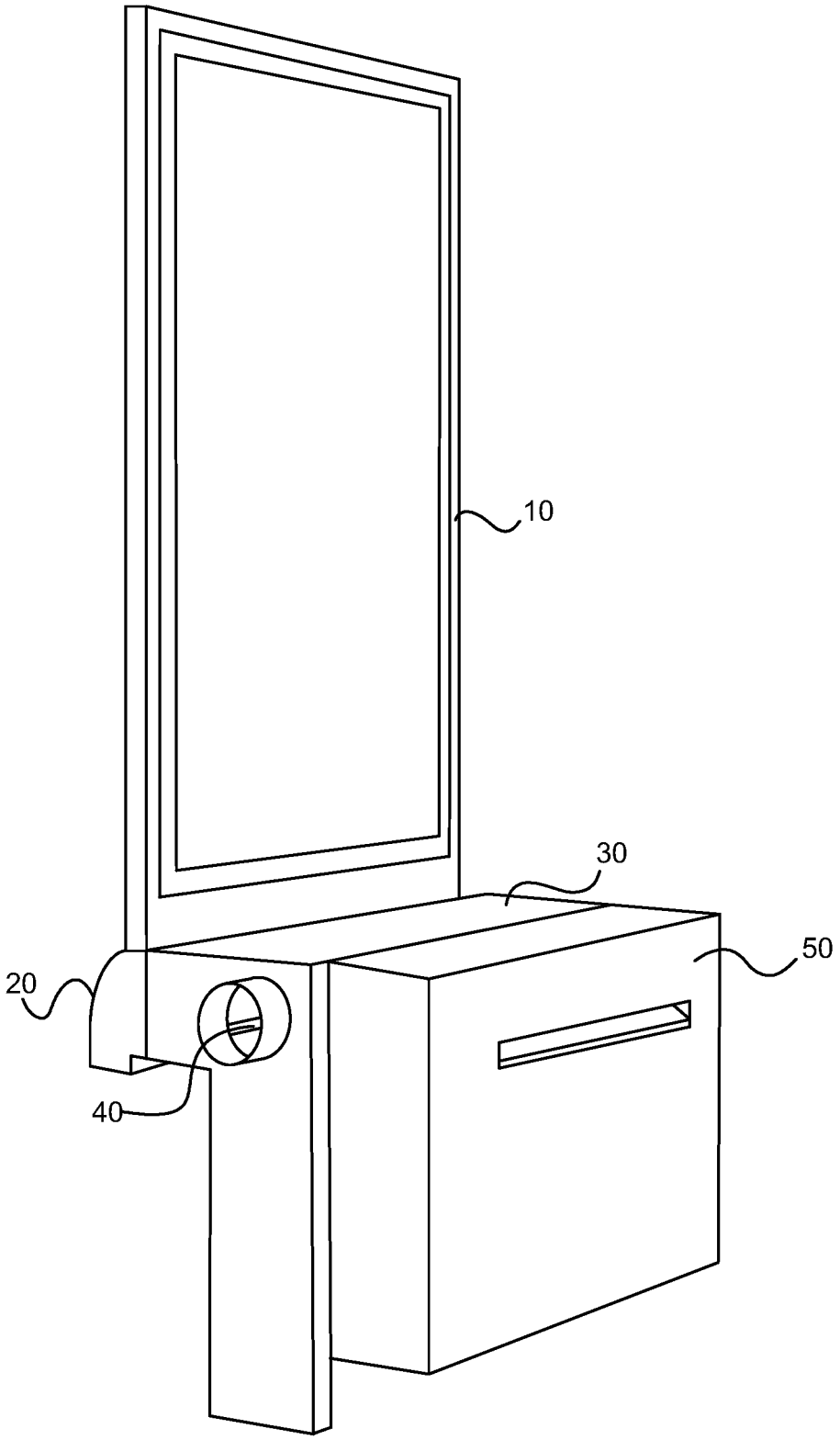
FIG. 1 is an interior view of a window-based HVAC system in its assembled form, in accordance with an embodiment of the disclosure.

The system in a simplified configuration of a first embodiment, as shown in FIG. 1, includes a vent hood 20 and a plenum box 30, the plenum box being adapted to connect with an HPAC unit 50, or other HVAC system components (not shown) such as a compressor, a condenser, a refrigerant line, and the like. In the embodiment shown in FIG. 1, a vent hood 20 is integrated into a window frame 10 below the window portion of the frame 10. In other embodiments, the vent hood 20 may be disposed above or alongside the window portion of the frame 10. In yet other embodiments, the vent hood 20 may be fitted into a wall opening. As will be explained below in further detail, the vent hood 20 is provided with a downward curved hooded portion that extends outside, beyond the exterior envelope of the building. The downward hood protects the vent from all forms of precipitation. The forward edge of the vent hood 20 extending into the interior of the building is attached to the plenum box 30. The plenum box 30 is configured to distribute intake and exhaust air and is provided with one or more collars to couple to existing intake and/or exhaust ducts. In the embodiment shown, the plenum box 30 is provided with a coupling collar surrounding an inlet 40 for connection to an existing intake or exhaust duct for a kitchen, bathroom, or the like. The plenum box 30 is additionally connected to a HPAC heating/cooling unit 50 that can be used to cool or heat one or more rooms in a building.

Figure 2:
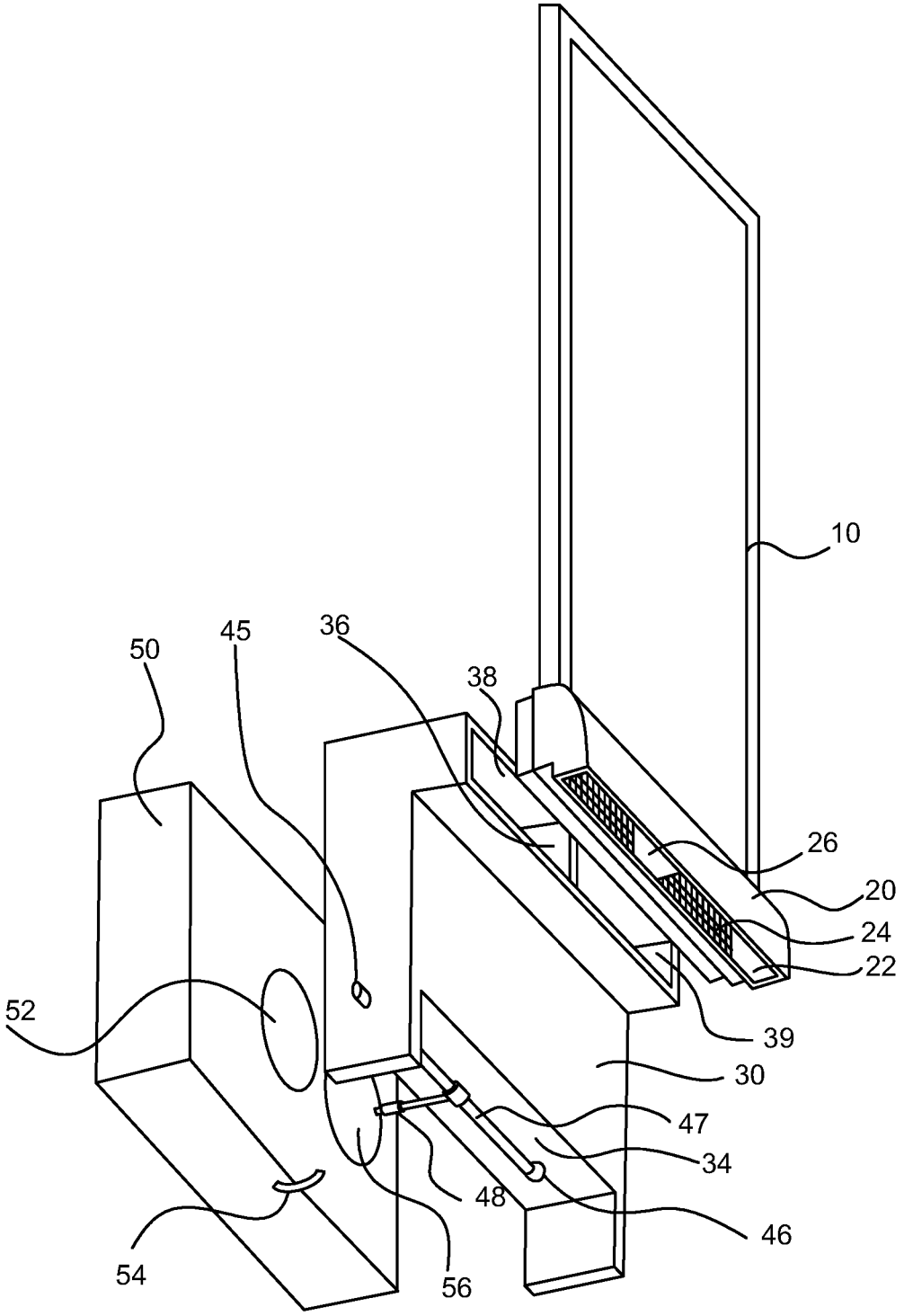
FIG. 2 is an exploded underside view of the HVAC system of FIG. 1.

The exploded view of FIG. 2 shows further details of the interconnections between components of the system. The downward curved portion of vent hood 20 is provided with a vent hood divider 26 that partitions the vent into a fresh air vent intake opening 22 and a vent exhaust opening (shown in subsequent FIGS. with reference numeral 28). A screen or mesh 24 attached inside or at the outer edge of the vent prevents intrusions by insects or birds or debris.

The plenum box 30 is also provided with a plenum divider 36. As will be explained in detail below, the plenum divider 36 extends internally throughout the plenum box 30 and partitions the box into intake and exhaust portions, with the plenum divider 36 positioned at the top of the plenum box 30 to create a plenum intake opening 39 and a plenum exhaust opening 38 that correspond and connect, respectively to the vent hood divider 26, the vent hood intake opening 22 and the vent hood exhaust opening 28.

The plenum box 30 is additionally provided with drainage for condensate. The plenum "floor" or base 34 is pitched slightly toward a condensate drain (not shown) on the interior of the plenum box 30. The drain is connected to a condensate nipple or elbow 46 on the exterior of the base 34. This nipple/elbow connects to a condensate drain line 47 that extends through a sidewall of the plenum box 30 to a plenum condensate line output 45. At an intermediate location of the condensate drain line 47, a plenum condensate connecting tube 48 branches off for connection to a condensate line of the HPAC unit 50.

The HPAC unit 50 that connects to the plenum box 30 may have an HPAC condensate tube 54 that is connectable to the plenum condensate connecting tube 48. The exterior facing side of the HPAC unit may be configured with an intake opening 56 and an exhaust opening 52 that correspond to similar openings (see FIGS. 3 and 4) on the plenum box 30. The HPAC exhaust opening 52 may optionally be provided with an exhaust fan (not shown).

Figure 3:
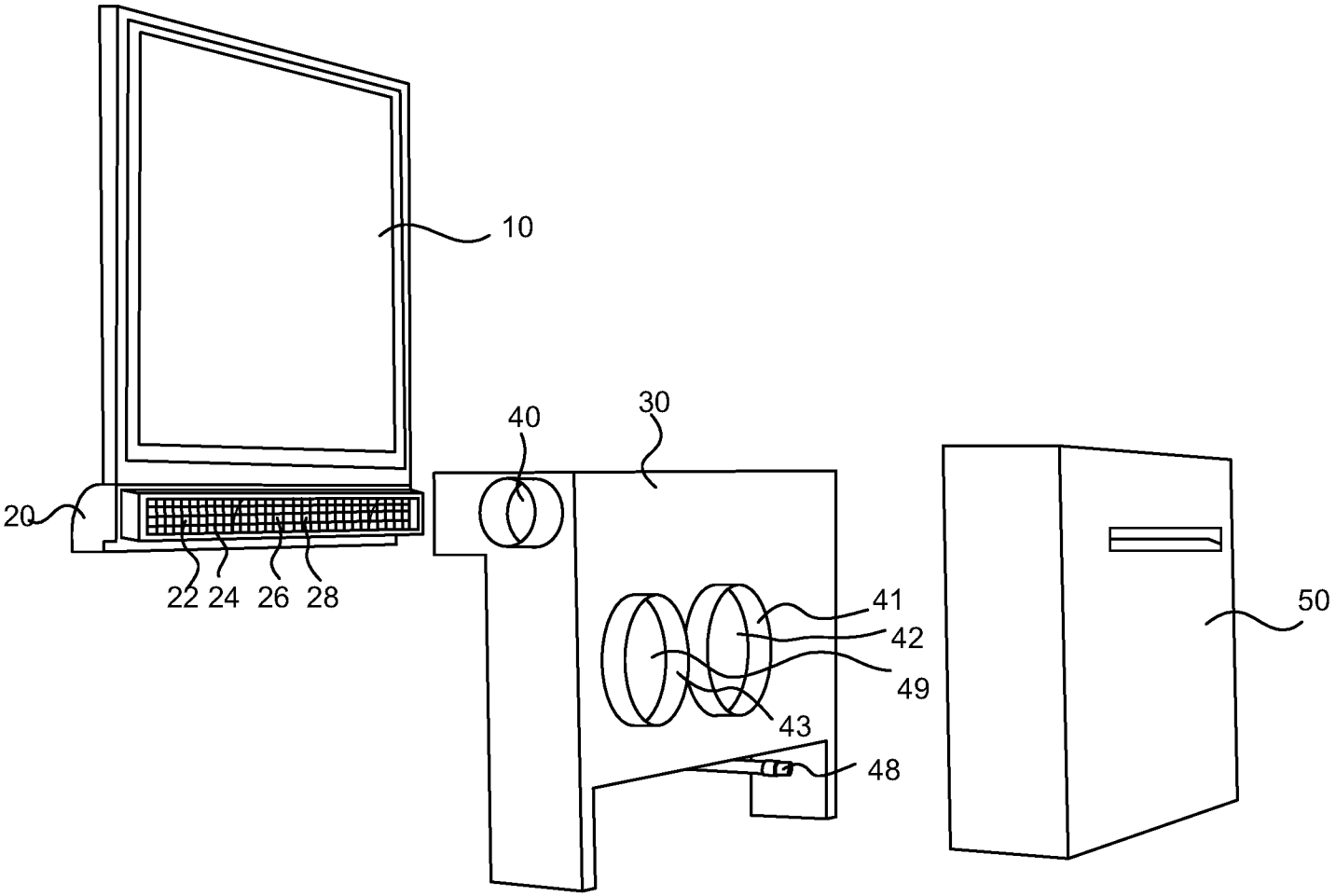
FIG. 3 is an interior separated view of the HVAC system of FIG. 1 with an optional bird screen.
Figure 4:
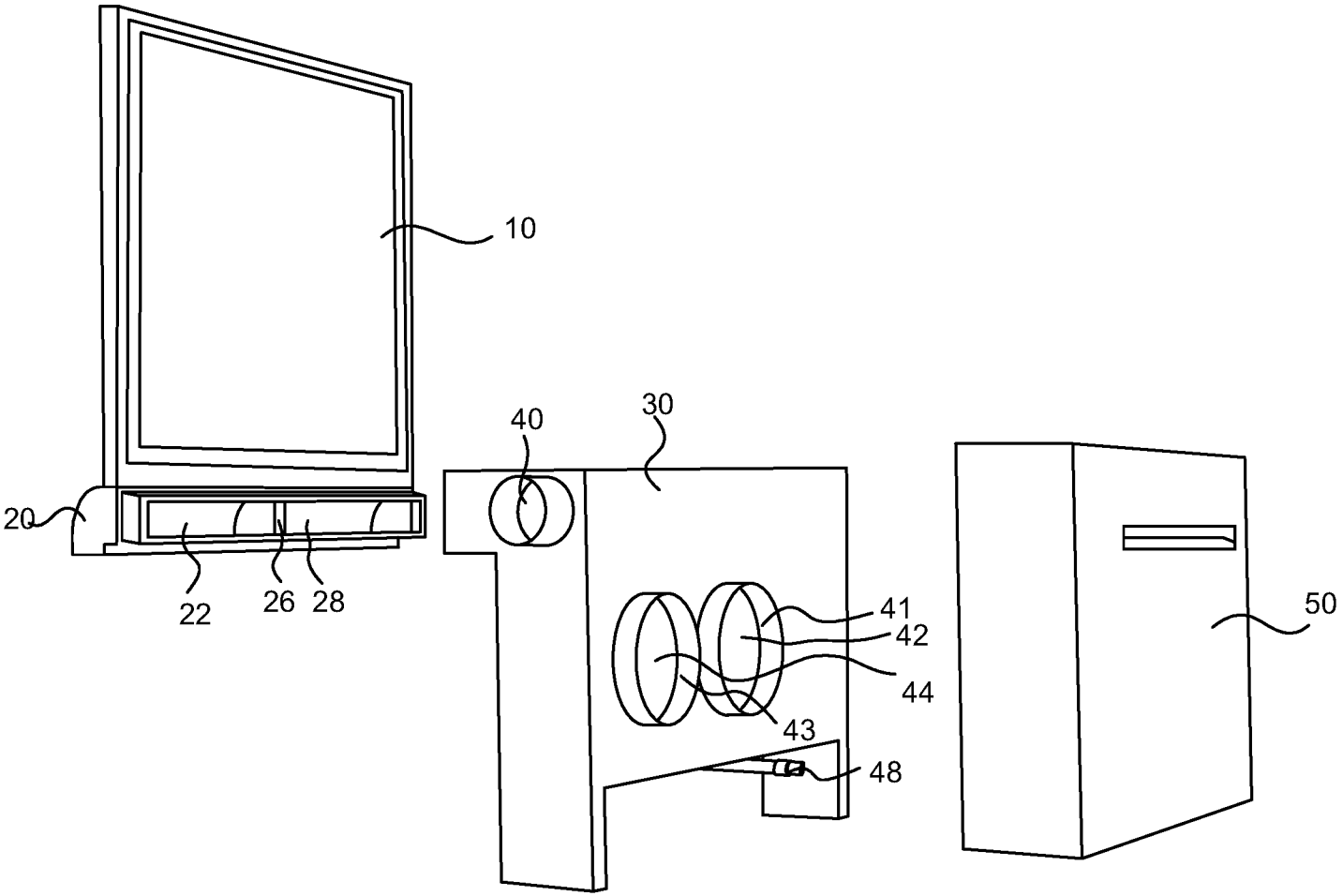
FIG. 4 is an illustration of the HVAC system of FIG. 3 without the optional bird screen.

FIGS. 3 and 4 show the vent hood 20, plenum box 30, and the HPAC unit 50 in an unconnected state, in a perspective view from a room interior. FIG. 3 shows the vent hood 20 equipped with the bird screen/mesh 24 and FIG. 4 shows the vent hood 20 without the bird screen/mesh 24.

As illustrated in both FIGS. 3 and 4, the plenum exhaust opening 42 is surrounded by a raised plenum exhaust collar 41 for connection to the HPAC exhaust opening 52 in FIG. 2. Similarly, the plenum intake opening 44 is surrounded by a raised intake collar 43 for connection to the HPAC intake opening 56 of FIG. 2. The provision of the raised collars 41, 43 enhances the sturdiness and reliability of the connections to the corresponding openings on the HPAC unit 50.

Figure 5:
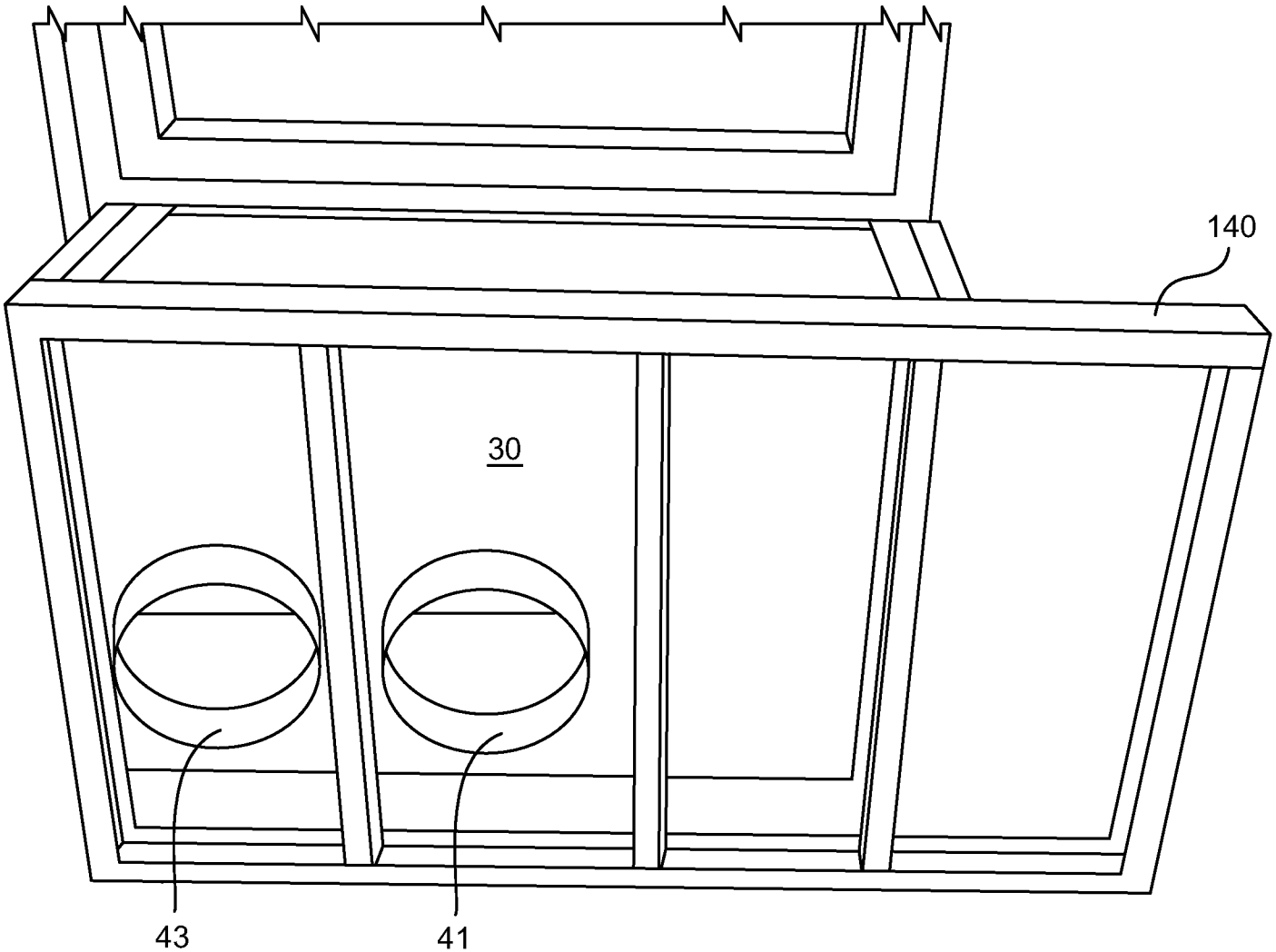
FIG. 5 is a front perspective view of an exemplary embodiment in which framing for a false wall is provided to cover the rear (room interior-facing) surface of a plenum box.
Figure 6:
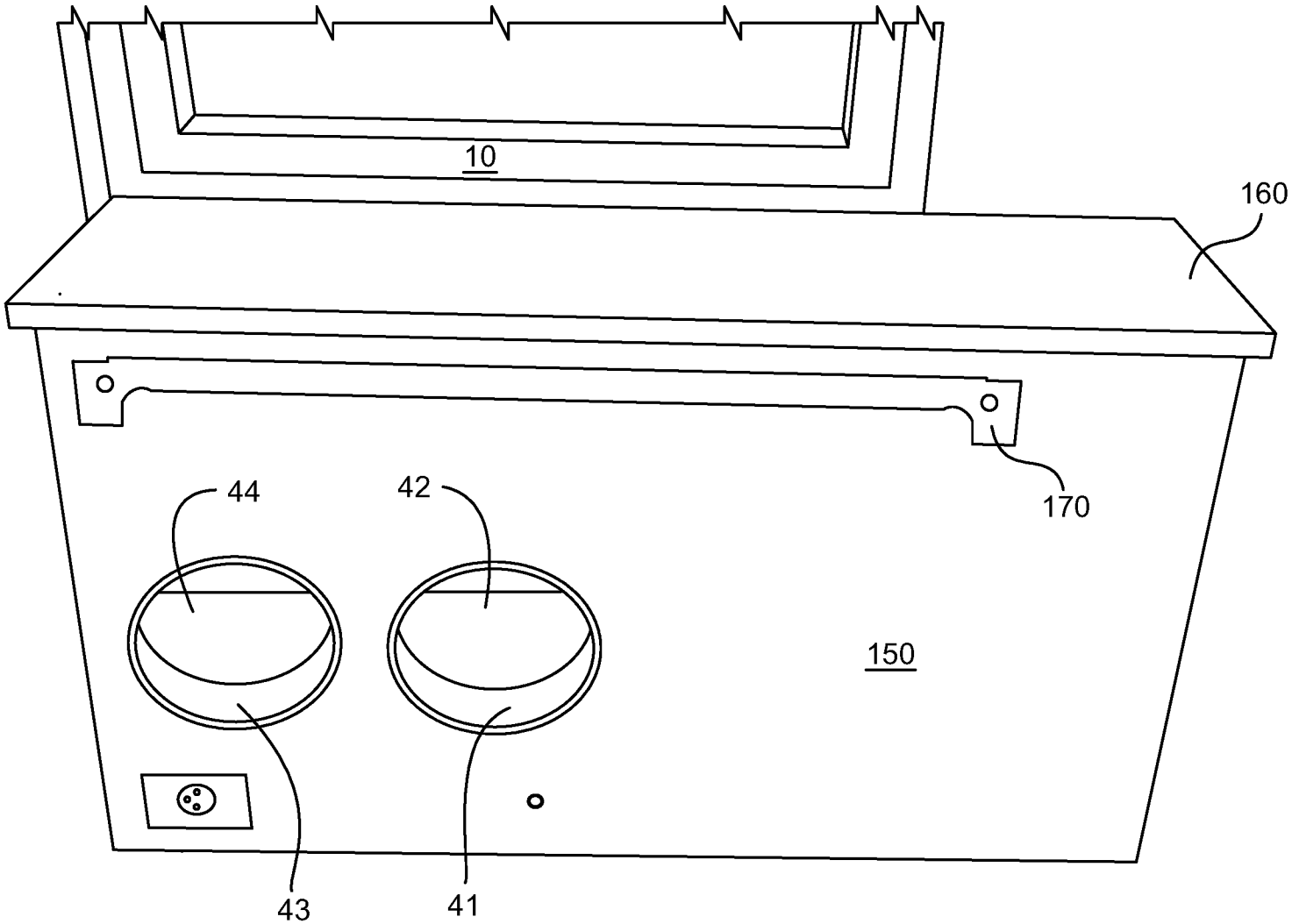
FIG. 6 is a front perspective view of a false wall covering the rear surface of the plenum box.

In some embodiments, a false wall may be provided to cover the rear (room interior-facing) surface of the plenum box 30. FIG. 5 shows an embodiment in which aluminum framing 140 is provided as a support structure that defines the dimensions of the false wall. FIG. 6 shows an embodiment of the false wall wherein gypsum board 150 has been secured to the aluminum framing 140. In this embodiment, the aluminum framing 140 is provided at the rear surface of the plenum box 30 such that the gypsum board 150, when secured to the aluminum framing 140, forms a substantially flat surface, flush with the edges of the raised collars 41, 43 extending from the rear surface of the plenum box 30. This substantially flat surface is a suitable surface to which the HPAC unit 50 may be attached. As can be seen in FIG. 6, the gypsum board 150 is provided with cutouts corresponding to the locations of the raised collars 41, 43 so as not to obstruct the flow of air through the plenum intake and exhaust openings 44, 42. The combination of the aluminum framing 140 and gypsum board 150 together creates a false wall that provides not only a suitable mounting surface for the HPAC unit 50, but may also provide benefits of greater sound and thermal insulation, added rigidity, and an aesthetically pleasing outer finish that enhances the overall appearance of the room.

Additionally, as shown in FIG. 6, a windowsill 160 may be provided above the aluminum framing 140 and below the window frame 10. Moreover, mounting hardware 170 for attaching the HPAC unit 50 may be secured to the aluminum framing 140 through the gypsum board 150.

Figure 7:
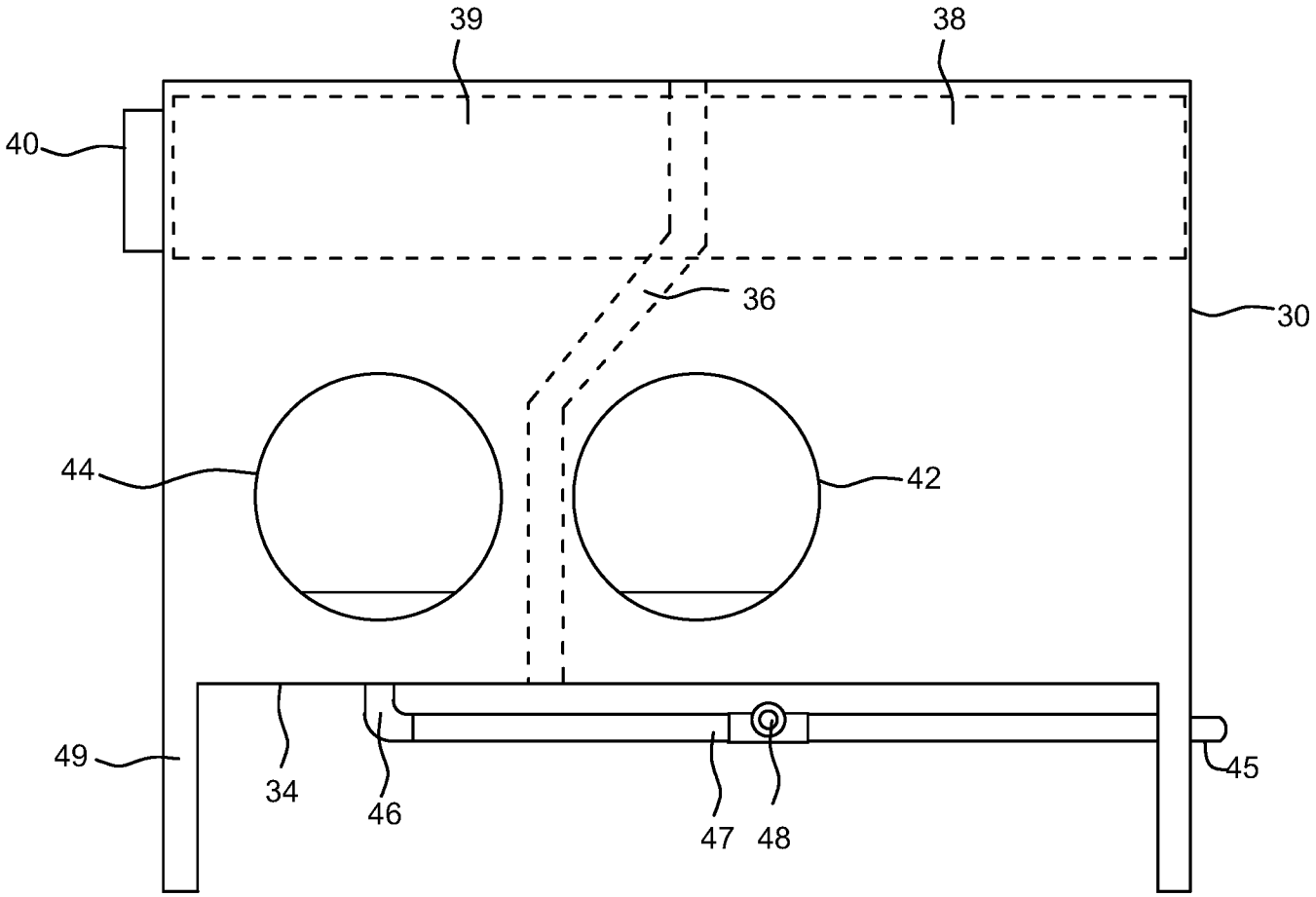
FIG. 7 is a front view of a plenum box and illustrates an exemplary interior partition of the plenum box in accordance with an embodiment of the disclosure.
Figure 8:
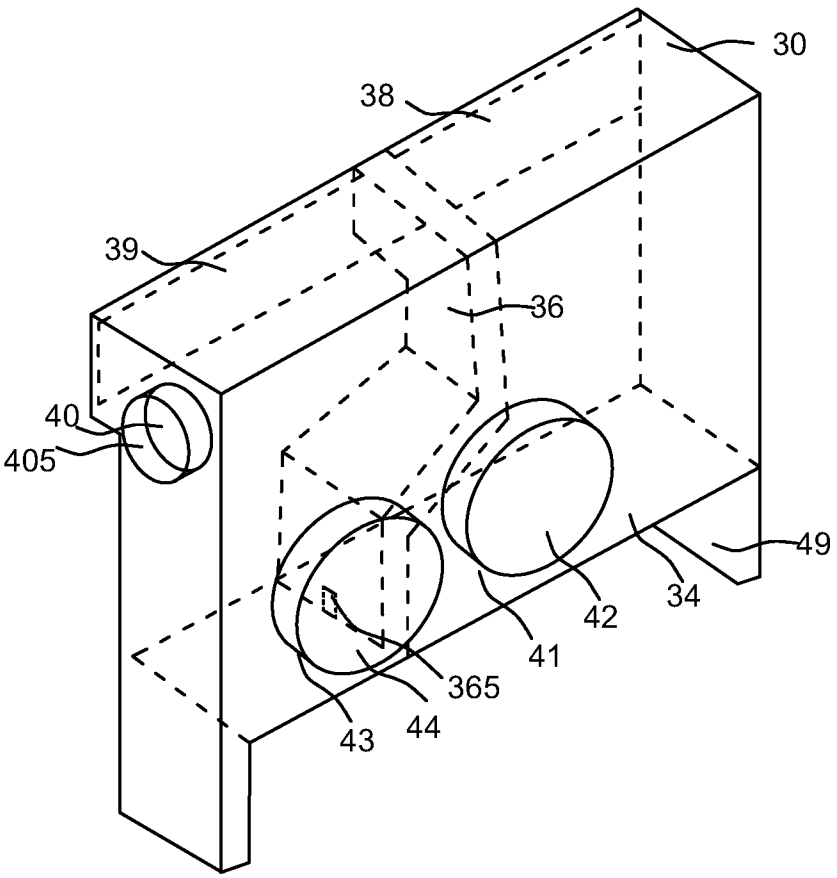
FIG. 8 is a perspective view of a plenum box and illustrates an exemplary interior partition of the plenum box in accordance with an embodiment of the disclosure.

An exemplary contour of the plenum divider 36 is shown in FIGS. 7 and 8. In the example shown, the divider 36 is configured to abut the top of the plenum box 30 approximately at the midpoint of the plenum box 30 such that the exhaust opening 38 and the intake opening 39 each have substantially the same dimensions and are suited for connection to the corresponding intake and exhaust openings 22, 28 of the vent hood 20. The contour of the plenum divider 36 determines the relative volumes of the exhaust and intake portions of the plenum box 30 and the plenum divider 36 may be deployed in various configurations according to the intake and exhaust needs of a particular application.

FIG. 8 additionally shows a plenum divider drainage passage 365 disposed at the bottom of the plenum divider 36. The drainage passage 365 allows condensate to flow along the pitched plenum floor 34 towards the condensate drain and nipple/elbow 46.

Figure 9:
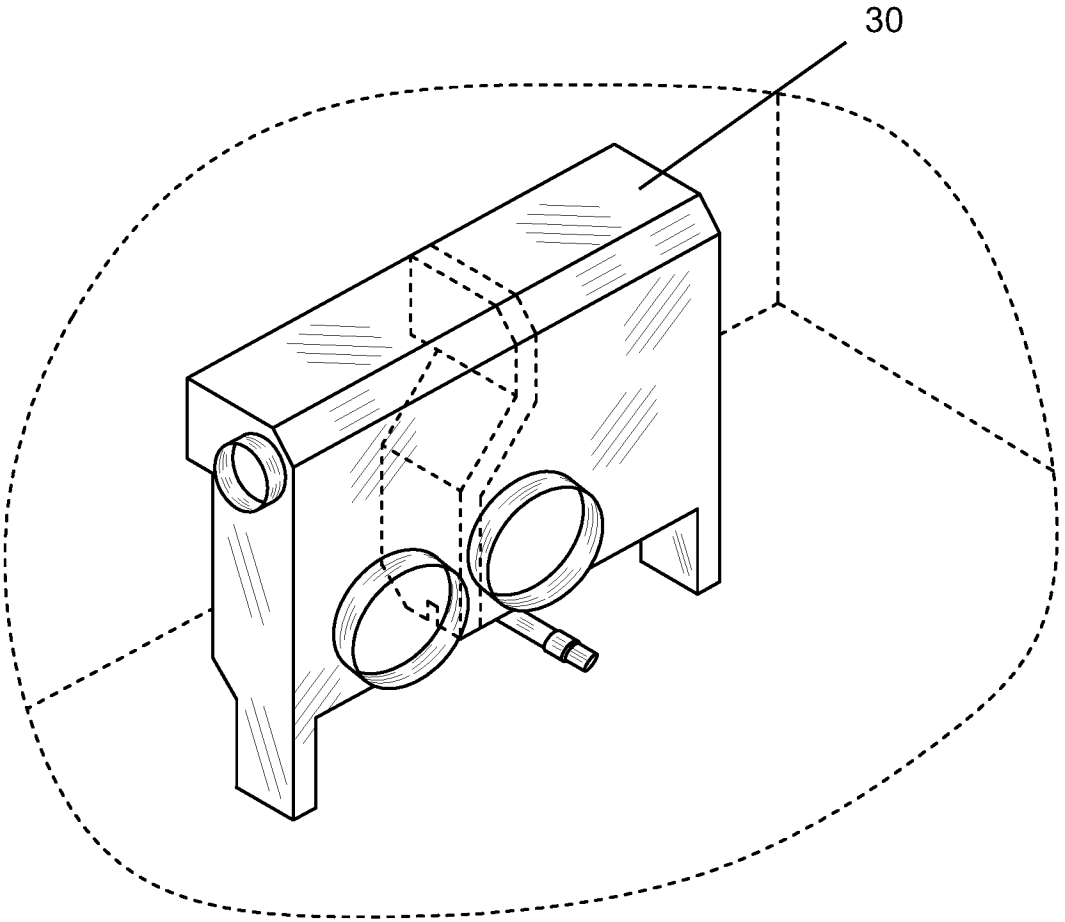
FIG. 9 is a perspective view of the plenum box of FIG. 8 disposed on the floor of a room.

FIG. 9 shows how the plenum box 30 may be installed in a room.

Figure 10:
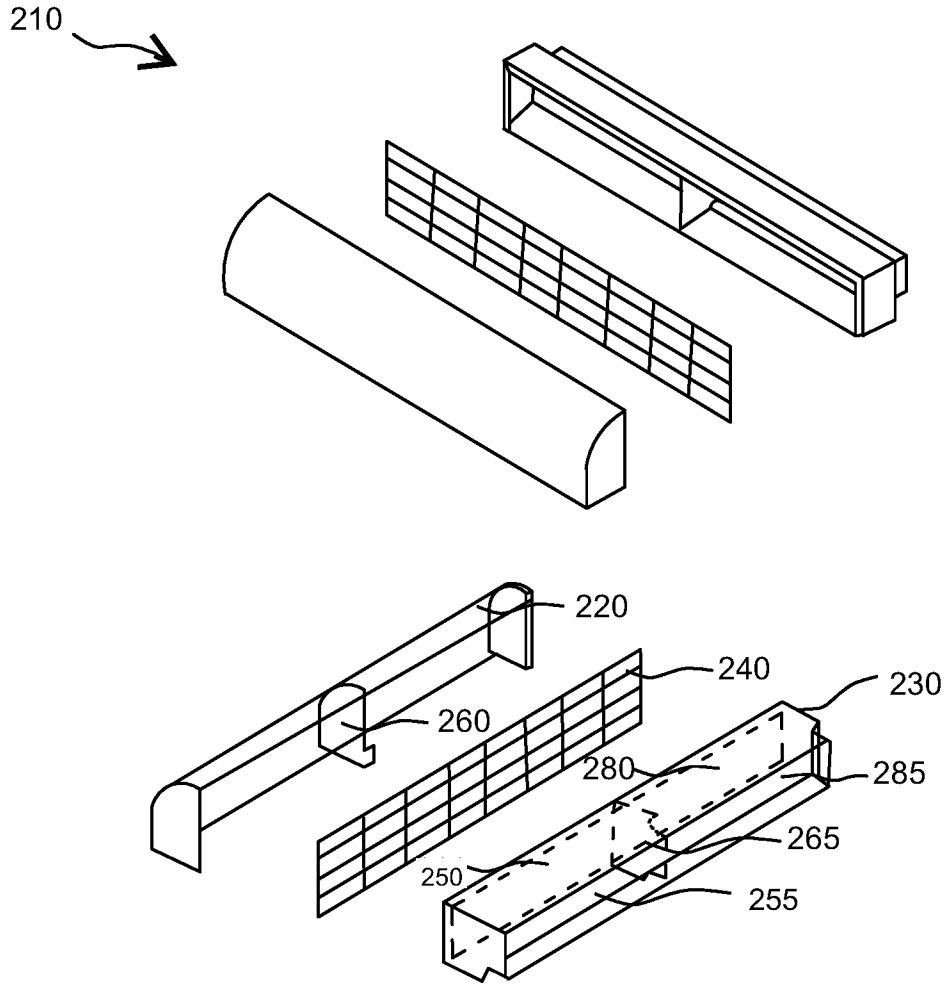
FIG. 10 is front and rear exploded perspective views of a vent hood assembly in accordance with an embodiment of the disclosure.

The hooded vent may have a unitary construction or may be constructed from several components such as shown in the exemplary hooded vent assembly 210 of FIG. 10. In this example, the hooded vent assembly 210 includes an external vent hood 220, an internal vent adapter 230, and a bird screen/mesh 240 that is interposed between the external vent 220 hood and internal vent adapter 230. The external vent hood 220 is provided with a vent hood divider 260 and the internal vent adapter 230 is similarly provided with an internal divider 265. The vent hood divider 260 and the internal divider 265 are aligned in substantially the same plane. The vent adapter 230 is provided on its exterior-facing side with an exhaust opening 280 and on its interior-facing side with a corresponding exhaust-from-plenum-box opening 285. The vent adapter 230 is similarly provided on its exterior-facing side with a fresh air intake opening 250 and on its interior-facing side with a corresponding fresh-air-intake-to-plenum-box opening 255.

Figure 11:
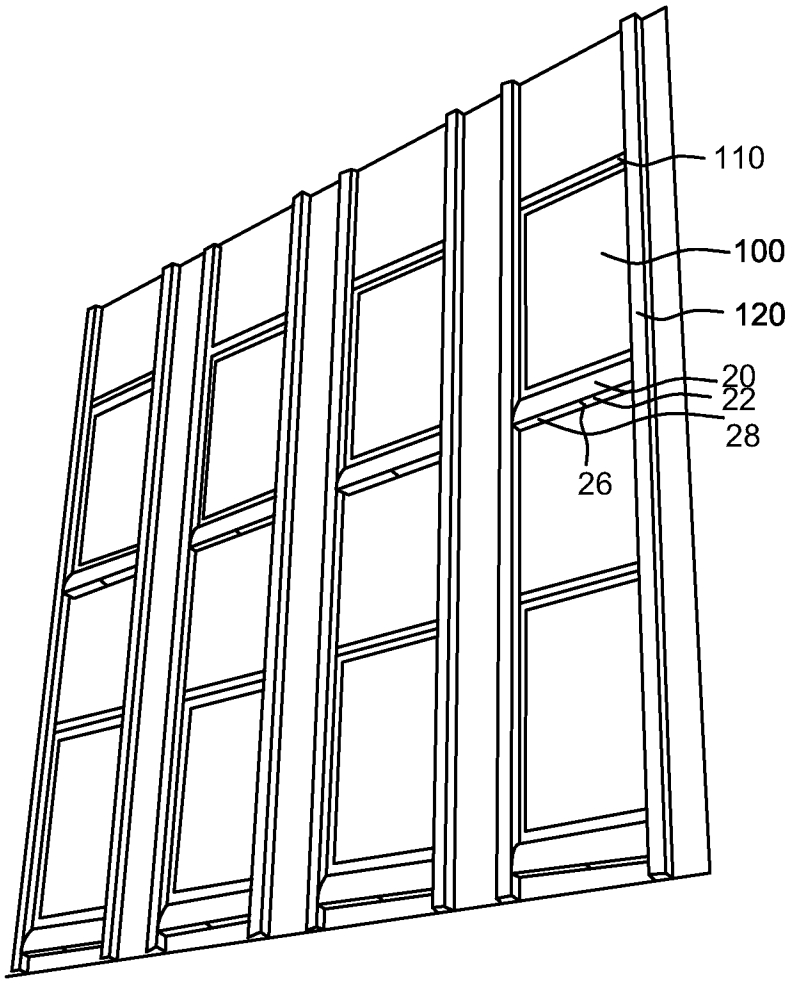
FIG. 11 is an exterior view of hooded vents installed below window facades in a building envelope, in accordance with an embodiment of the disclosure.

FIG. 11 shows the appearance of the facade of a building equipped with an embodiment of the window-based HVAC system as disclosed herein. A window and its frame 100 are secured by a header 110 above, and vertical mullions 120 on left and right sides. The vent hood 20 protrudes from below the bottom of the window frame. On the underside of the vent hood 20 can be seen the fresh air intake opening 22, the exhaust opening 28, and the vent hood divider 26.

Accordingly, the system described herein provides a clean and unobtrusive appearance, as viewed from both the interior and exterior of the building. Window size and sight lines are unaffected. The system provides the required air intake and exhaust, for example, to properly operate an HPAC unit which provides air conditioning/heating for interior spaces. This is especially useful in locations or areas where windows are not available or cannot be opened, such as high-rise buildings, hospitals, and secure facilities.

In certain embodiments, a window frame may be configured to receive the vent hood on the exterior and the plenum box on the interior of the building.

The window-based HVAC system disclosed herein provides an innovative solution for providing heating, cooling, and fresh air ventilation and is suitable for use in various residential and commercial buildings. Requiring only a wall opening sized to match the dimensions of the vent hood, the system is especially advantageous when upgrading existing HVAC systems as it can easily be retrofitted to existing buildings. Moreover, the system is configured to connect easily to a commercially available HPAC units or the like.

Although various embodiments of the window-based HVAC system of this disclosure have been described herein, a number of design modifications and additional advantages may become evident to persons having ordinary skill in the art. While the illustrative embodiments have been described in considerable detail, it is not the intention of the applicant to restrict or in any way limit the scope of the claims that follow below.

What is claimed is:

1. A window-based HVAC interface system comprising:

a hooded vent assembly operable to provide airflow to an HVAC system from an atmosphere external to a room, the hooded vent assembly configured to be used with a window assembly, and further configured to have a vent hood divider operable to divide an interior of the hooded vent assembly into an air intake portion and an air exhaust portion; and a plenum box configured to be positioned within the room, and having an interior plenum divider operable to divide an interior of the plenum box into a plenum air intake portion and a plenum air exhaust portion, the plenum box configured to be connectable to the hooded vent assembly such that the vent hood divider interfaces with the plenum box divider such that the air intake portion and air exhaust portion of the hooded vent assembly respectively interface to the plenum air intake portion and the plenum air exhaust portion. the plenum box being further configured to interface to the HVAC system, wherein the hooded vent assembly is adjustable such that relative sizes of the air intake portion and the air exhaust portion are reciprocally adjustable, and wherein the plenum box divider is adjustable such that relative sizes of the plenum air intake portion and the plenum air exhaust portion are reciprocally adjustable.

2. A window-based HVAC interface system comprising:

a hooded vent assembly operable to provide airflow to an HVAC system from an atmosphere external to a room, the hooded vent assembly configured to be used with a window assembly, and further configured to have a vent hood divider operable to divide an interior of the hooded vent assembly into an air intake portion and an air exhaust portion; and a plenum box configured to be positioned within the room, and having an interior plenum divider operable to divide an interior of the plenum box into a plenum air intake portion and a plenum air exhaust portion, the plenum box configured to be connectable to the hooded vent assembly such that the vent hood divider interfaces with the plenum box divider such that the air intake portion and air exhaust portion of the hooded vent assembly respectively interface to the plenum air intake portion and the plenum air exhaust portion, the plenum box being further configured to interface to the HVAC system, wherein the hooded vent assembly is adjustable such that relative sizes of the air intake portion and the air exhaust portion are reciprocally adjustable, and wherein the plenum box divider includes a plurality of nonplanar sections.

3. The window-based HVAC interface system of claim 2, wherein the plenum box divider is operable to divide the plenum box into unequal sized air intake and air exhaust portions.

4. A window-based HVAC system comprising:

an HVAC system;

a hooded vent assembly operable to provide airflow to the HVAC system from an atmosphere external to a room, the hooded vent assembly configured to be integrated as part of a window assembly, and further configured to have a vent hood divider operable to divide an interior of the hooded vent assembly into an air intake portion and an air exhaust portion, the hooded vent assembly further comprising an external vent hood extending outside of the window and configured to prevent debris or precipitation from entering the vent and a screen disposed in a vicinity of the external vent hood;

a plenum box configured to be positioned within the room, and having an interior plenum divider operable to divide an interior of the plenum box into a plenum air intake portion and a plenum air exhaust portion, the plenum box configured to be connectable to the hooded vent assembly such that the vent hood divider interfaces with the plenum box divider such that the air intake portion and air exhaust portion of the hooded vent assembly respectively interface to the plenum air intake portion and the plenum air exhaust portion, the plenum box further including a plenum exhaust opening and a plenum intake opening at a rear surface of the plenum box and operable to interface with corresponding openings of the HVAC system, the plenum exhaust opening and the plenum intake opening each mated to a corresponding raised collar extending from the rear surface of the plenum box;

a framing structure provided at the rear surface of the plenum box and having a depth substantially equivalent to a depth of the raised collars;

a wall operable to cover the rear surface of the plenum box when attached to the framing structure, the wall being provided with cutouts corresponding to the locations of the raised collars so as not to obstruct the flow of air through the plenum intake and exhaust openings; and wherein the wall when secured to the framing structure forms a substantially flat surface which is substantially flush with the edges of the raised collars extending from the rear surface of the plenum box to which the HVAC unit may be attached.

5. The window-based HVAC system of claim 4, wherein the plenum exhaust opening and the plenum intake opening are asymmetrically positioned in the rear surface of the plenum box.

* * * * *